US009083113B2

(12) United States Patent
Wild et al.

(10) Patent No.: US 9,083,113 B2
(45) Date of Patent: Jul. 14, 2015

(54) COMPRESSION CONNECTOR FOR CLAMPING/SEIZING A COAXIAL CABLE AND AN OUTER CONDUCTOR

(71) Applicant: John Mezzalingua Associates, Inc., East Syracuse, NY (US)

(72) Inventors: Werner K. Wild, Buttenwiesen (DE); Ian J. Baker, Baldwinsville, NY (US); Nicholas Gianelle, West Henrietta, NY (US); Noah Montena, Syracuse, NY (US); Christopher P. Natoli, Fulton, NY (US); Adam T. Nugent, Canastota, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 123 days.

(21) Appl. No.: 13/661,962

(22) Filed: Oct. 26, 2012

(65) Prior Publication Data

US 2013/0178097 A1 Jul. 11, 2013

Related U.S. Application Data

(60) Provisional application No. 61/585,481, filed on Jan. 11, 2012.

(51) Int. Cl.
*H01R 9/05* (2006.01)
*H01R 13/623* (2006.01)
(Continued)

(52) U.S. Cl.
CPC ..... *H01R 13/623* (2013.01); *H01R 9/05* (2013.01); *H01R 24/564* (2013.01); *H01R 43/00* (2013.01); *H01R 9/0521* (2013.01); *Y10T 29/49208* (2015.01)

(58) Field of Classification Search
CPC ..... H01R 9/05
USPC ..... 439/578–595, 720, 741, 870, 266, 878, 439/470; 174/88 C, 102 R, 84 R, 84 S
See application file for complete search history.

(56) References Cited

U.S. PATENT DOCUMENTS 3,764,959 A 10/1973 Toma et al.
3,910,673 A 10/1975 Stokes
(Continued)

FOREIGN PATENT DOCUMENTS

DE 4344328 C1 1/1995
EP 1858123 A2 11/2007
(Continued)

OTHER PUBLICATIONS

PCT/US2013/020794 Date of mailing: Mar. 26, 2013 International Search Report and Written Opinion. pp. 8.
(Continued)

*Primary Examiner* — Abdullah Riyami
*Assistant Examiner* — Harshad Patel
(74) *Attorney, Agent, or Firm* — Barclay Damon, LLP

(57) ABSTRACT

A connector comprising a connector body having a first end and a second end, the connector body configured to receive a prepared coaxial cable, the prepared coaxial cable including an outer conductor and a center conductor, a clamp disposed within the connector body, the clamp including an internally threaded portion and a ramped surface, wherein the clamp threadably engages the prepared coaxial cable, a moveable ramped component disposed within the connector body, the moveable ramped component including an internally ramped surface, and a compression member configured for axial movable engagement with the connector body, wherein, upon axial compression of the compression member, the outer conductor flares out and is pressed between the ramped surface of the clamp and the internally ramped surface of the moveable ramped component is provided. Furthermore, a clamp and an associated method are also provided.

5 Claims, 6 Drawing Sheets

(51) Int. Cl.
*H01R 43/00* (2006.01)
*H01R 24/56* (2011.01)

(56) References Cited

U.S. PATENT DOCUMENTS

| | | | |
|---|---|---|---|
| 4,531,805 | A | 7/1985 | Werth |
| 4,579,415 | A | 4/1986 | Van Brunt et al. |
| 4,676,577 | A | 6/1987 | Szegda |
| 4,808,128 | A | 2/1989 | Werth |
| 4,952,174 | A | 8/1990 | Sucht et al. |
| 5,137,470 | A | 8/1992 | Doles |
| 5,167,533 | A | 12/1992 | Rauwolf |
| 5,199,894 | A | 4/1993 | Kalny et al. |
| 5,322,454 | A | 6/1994 | Thommen |
| 5,393,244 | A | 2/1995 | Szegda |
| 5,397,243 | A | 3/1995 | MacMurdo, Sr. |
| 5,435,745 | A | 7/1995 | Booth |
| 5,518,420 | A | 5/1996 | Pitschi |
| 5,620,339 | A | 4/1997 | Gray et al. |
| 5,720,630 | A | 2/1998 | Richmond et al. |
| 5,766,037 | A | 6/1998 | Nelson |
| 5,863,220 | A | 1/1999 | Holliday |
| 5,938,474 | A | 8/1999 | Nelson |
| 5,984,723 | A | 11/1999 | Wild |
| 6,019,519 | A | 2/2000 | Grinderslev et al. |
| 6,019,636 | A | 2/2000 | Langham |
| 6,032,358 | A | 3/2000 | Wild |
| 6,102,738 | A | 8/2000 | Macek et al. |
| 6,109,964 | A | 8/2000 | Kooiman |
| 6,123,567 | A | 9/2000 | McCarthy |
| 6,133,532 | A | 10/2000 | Lundback et al. |
| 6,183,298 | B1 | 2/2001 | Henningsen et al. |
| 6,203,360 | B1 | 3/2001 | Harting et al. |
| 6,206,579 | B1 | 3/2001 | Selfridge et al. |
| 6,264,374 | B1 | 7/2001 | Selfridge et al. |
| 6,267,621 | B1 | 7/2001 | Pitschi et al. |
| 6,272,738 | B1 | 8/2001 | Holliday et al. |
| 6,309,251 | B1 | 10/2001 | Tang |
| 6,331,123 | B1 | 12/2001 | Rodrigues |
| 6,386,915 | B1 | 5/2002 | Nelson |
| 6,471,545 | B1 | 10/2002 | Hosler, Sr. |
| 6,478,618 | B2 | 11/2002 | Wong |
| 6,494,743 | B1 | 12/2002 | Lamatsch et al. |
| 6,569,565 | B2 | 5/2003 | Ligeois et al. |
| 6,607,398 | B2 | 8/2003 | Henningsen |
| 6,733,336 | B1 | 5/2004 | Montena et al. |
| 6,840,803 | B2 | 1/2005 | Wlos et al. |
| 6,860,761 | B2 | 3/2005 | Lee et al. |
| 6,878,049 | B2 | 4/2005 | Heidelberger et al. |
| 6,884,113 | B1 | 4/2005 | Montena |
| 6,884,115 | B2 | 4/2005 | Malloy |
| 6,939,169 | B2 | 9/2005 | Islam et al. |
| 6,955,562 | B1 | 10/2005 | Henningsen |
| 6,976,872 | B1 | 12/2005 | Wild et al. |
| 7,008,264 | B2 | 3/2006 | Wild |
| 7,021,965 | B1 | 4/2006 | Montena |
| 7,029,304 | B2 | 4/2006 | Montena |
| 7,029,326 | B2 | 4/2006 | Montena |
| 7,070,447 | B1 | 7/2006 | Montena |
| 7,077,699 | B2 | 7/2006 | Islam et al. |
| 7,086,897 | B2 | 8/2006 | Montena |
| 7,104,839 | B2 | 9/2006 | Henningsen et al. |
| 7,108,547 | B2 | 9/2006 | Kisling et al. |
| 7,112,093 | B1 | 9/2006 | Holland |
| 7,121,883 | B1 | 10/2006 | Petersen et al. |
| 7,128,603 | B2 | 10/2006 | Burris et al. |
| 7,131,868 | B2 | 11/2006 | Montena |
| 7,156,560 | B2 | 1/2007 | Seeley |
| 7,156,696 | B1 | 1/2007 | Montena |
| 7,163,420 | B2 | 1/2007 | Montena |
| 7,189,115 | B1 | 3/2007 | Montena |
| 7,192,308 | B2 * | 3/2007 | Rodrigues et al. ..... 439/578 |
| 7,207,838 | B2 | 4/2007 | Andreescu |
| 7,264,502 | B2 | 9/2007 | Holland |
| 7,278,854 | B1 | 10/2007 | Robinette et al. |
| 7,303,435 | B2 | 12/2007 | Burris et al. |
| 7,309,255 | B2 | 12/2007 | Rodrigues |
| 7,335,059 | B2 | 2/2008 | Vaccaro |
| 7,347,729 | B2 | 3/2008 | Thomas et al. |
| 7,351,101 | B1 | 4/2008 | Montena |
| 7,357,672 | B2 | 4/2008 | Montena |
| 7,458,850 | B1 | 12/2008 | Burris et al. |
| 7,458,851 | B2 | 12/2008 | Montena |
| 7,497,729 | B1 | 3/2009 | Wei |
| 7,513,722 | B2 | 4/2009 | Greenberg et al. |
| 7,527,512 | B2 | 5/2009 | Montena |
| 7,566,243 | B1 | 7/2009 | Hung |
| 7,588,460 | B2 | 9/2009 | Malloy et al. |
| 7,632,143 | B1 | 12/2009 | Islam |
| 7,637,774 | B1 | 12/2009 | Vaccaro |
| 7,806,724 | B2 | 10/2010 | Paynter et al. |
| 7,824,215 | B2 | 11/2010 | Islam et al. |
| 7,857,661 | B1 | 12/2010 | Islam |
| 7,918,687 | B2 | 4/2011 | Paynter et al. |
| 7,927,134 | B2 | 4/2011 | Paynter et al. |
| 7,934,954 | B1 * | 5/2011 | Chawgo et al. ..... 439/578 |
| 7,993,159 | B2 | 8/2011 | Chawgo |
| 8,007,314 | B2 | 8/2011 | Chawgo et al. |
| 8,038,472 | B2 | 10/2011 | Montena et al. |
| 8,047,870 | B2 | 11/2011 | Clausen |
| 8,123,557 | B2 | 2/2012 | Montena et al. |
| 8,136,236 | B2 | 3/2012 | Amato |
| 8,177,583 | B2 | 5/2012 | Chawgo et al. |
| 8,298,006 | B2 | 10/2012 | Wild et al. |
| 2005/0079761 | A1 | 4/2005 | Rodrigues |
| 2006/0014427 | A1 | 1/2006 | Islam et al. |
| 2006/0134979 | A1 | 6/2006 | Henningsen |
| 2006/0199431 | A1 | 9/2006 | Paynter |
| 2006/0246774 | A1 | 11/2006 | Buck |
| 2007/0149047 | A1 | 6/2007 | Wild et al. |
| 2007/0270032 | A1 | 11/2007 | Eriksen |
| 2008/0003873 | A1 | 1/2008 | Henningsen |
| 2008/0254678 | A1 | 10/2008 | Amidon |
| 2008/0274643 | A1 | 11/2008 | Chawgo |
| 2009/0197465 | A1 | 8/2009 | Montena et al. |
| 2009/0233482 | A1 | 9/2009 | Chawgo et al. |
| 2009/0269979 | A1 | 10/2009 | Montena |
| 2010/0261381 | A1 | 10/2010 | Montena et al. |
| 2010/0261382 | A1 | 10/2010 | Montena et al. |
| 2010/0273340 | A1 | 10/2010 | Clausen |
| 2011/0008998 | A1 | 1/2011 | Low et al. |
| 2011/0009000 | A1 | 1/2011 | Paynter |
| 2011/0021074 | A1 | 1/2011 | Paynter et al. |
| 2011/0239455 | A1 | 10/2011 | Montena et al. |
| 2011/0263154 | A1 | 10/2011 | Chawgo et al. |
| 2012/0088381 | A1 | 4/2012 | Wild et al. |
| 2012/0088404 | A1 | 4/2012 | Wild et al. |
| 2012/0088405 | A1 | 4/2012 | Wild et al. |
| 2012/0088406 | A1 | 4/2012 | Montena et al. |
| 2012/0088407 | A1 | 4/2012 | Natoli |
| 2012/0102733 | A1 | 5/2012 | Wild |
| 2012/0214338 | A1 | 8/2012 | Nugent |
| 2012/0252265 | A1 | 10/2012 | Wild et al. |

FOREIGN PATENT DOCUMENTS

| | | | |
|---|---|---|---|
| EP | 2190068 | A1 | 5/2010 |
| EP | 2219267 | B1 | 8/2010 |
| KR | 200351496 | Y1 | 5/2004 |
| WO | 2005004290 | A1 | 1/2005 |
| WO | 2007101435 | A1 | 9/2007 |

OTHER PUBLICATIONS

Design U.S. Appl. No. 29/418,699, filed Apr. 19, 2012.
Design U.S. Appl. No. 29/418,701, filed Apr. 19, 2012.

* cited by examiner

Date: 1/11/2012 SUMMITEK Time: 12:57 PM

Passive IM Test Results

*Description*

UAL-DM-540

*Carrier Sweep*

| *ALC is on* | *Measured Power* | *Offset* |
|---|---|---|
| F2 DOWN from 1990.0 to 1951.0 MHz. F1 Fixed at 1930.0 MHz | *19.8 Watt* | *1.0* |
| F1 UP from 1930.0 to 1950.0 MHz. F2 Fixed at 1990.0 MHz | *19.8 Watt* | *1.0* |

*Passive IM Response (IM3)*

REVERSE IM

Summitek Instruments VFP: SI-1900 Rev. 5.0.1000

COMPRESSION CONNECTOR FOR CLAMPING/SEIZING A COAXIAL CABLE AND AN OUTER CONDUCTOR

CROSS-REFERENCE TO RELATED APPLICATIONS

This application claims priority to U.S. Provisional Application No. 61/585,481 filed Jan. 11, 2012, and entitled "COMPRESSION CONNECTOR FOR CLAMPING/SEIZING A COAXIAL CABLE AND AN OUTER CONDUCTOR."

FIELD OF TECHNOLOGY

The following relates to connectors used in coaxial cable communications, and more specifically to embodiments of a connector having improved clamping of a coaxial cable and an outer conductor.

BACKGROUND

Connectors for coaxial cables are typically connected to complementary interface ports or corresponding connectors to electrically integrate coaxial cables to various electronic devices, including ports on cell towers. Coaxial cable typically includes an inner conductor, an insulating layer surrounding the inner conductor, an outer conductor surrounding the insulating layer, and a protective jacket surrounding the outer conductor. Each type of coaxial cable has a characteristic impedance which is the opposition to signal flow in the coaxial cable. The impedance of a coaxial cable depends on its dimensions and the materials used in its manufacture. For example, a coaxial cable can be tuned to a specific impedance by controlling the diameters of the inner and outer conductors and the dielectric constant of the insulating layer. All of the components of a coaxial system should have the same impedance in order to reduce internal reflections at connections between components. Such reflections increase signal loss and can result in the reflected signal reaching a receiver with a slight delay from the original.

Two sections of a coaxial cable in which it can be difficult to maintain a consistent impedance are the terminal sections on either end of the cable to which connectors are attached. For example, the attachment of some field-installable compression connectors requires the removal of a section of the insulating layer at the terminal end of the coaxial cable in order to insert a support structure of the compression connector between the inner conductor and the outer conductor. The support structure of the compression connector can prevent the collapse of the outer conductor when the compression connector applies pressure to the outside of the outer conductor. Unfortunately, however, the dielectric constant of the support structure often differs from the dielectric constant of the insulating layer that the support structure replaces, which changes the impedance of the terminal ends of the coaxial cable. This change in the impedance at the terminal ends of the coaxial cable causes increased internal reflections, which results in increased signal loss.

Another difficulty with field-installable connectors, such as compression connectors or screw-together connectors, is maintaining acceptable levels of passive intermodulation (PIM). PIM in the terminal sections of a coaxial cable can result from nonlinear and insecure contact between surfaces of various components of the connector. A nonlinear contact between two or more of these surfaces can cause micro arcing or corona discharge between the surfaces, which can result in the creation of interfering RF signals. For example, some screw-together connectors are designed such that the contact force between the connector and the outer conductor is dependent on a continuing axial holding force of threaded components of the connector. Over time, the threaded components of the connector can inadvertently separate, thus resulting in nonlinear and insecure contact between the connector and the outer conductor.

Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower-powered cellular devices. Disrupted communication can result in dropped calls or severely limited data rates, for example, which can result in dissatisfied customers and customer churn.

Current attempts to solve these difficulties with field-installable connectors generally consist of employing a pre-fabricated jumper cable having a standard length and having factory-installed soldered or welded connectors on either end. These soldered or welded connectors generally exhibit stable impedance matching and PIM performance over a wider range of dynamic conditions than current field-installable connectors. These pre-fabricated jumper cables are inconvenient, however, in many applications.

For example, each particular cellular communication tower in a cellular network generally requires various custom lengths of coaxial cable, necessitating the selection of various standard-length jumper cables that is each generally longer than needed, resulting in wasted cable. Also, employing a longer length of cable than is needed results in increased insertion loss in the cable. Further, excessive cable length takes up more space on the tower. Moreover, it can be inconvenient for an installation technician to have several lengths of jumper cable on hand instead of a single roll of cable that can be cut to the needed length. Also, factory testing of factory-installed soldered or welded connectors for compliance with impedance matching and PIM standards often reveals a relatively high percentage of non-compliant connectors. This percentage of non-compliant, and therefore unusable, connectors can be as high as about ten percent of the connectors in some manufacturing situations. For all these reasons, employing factory-installed soldered or welded connectors on standard-length jumper cables to solve the above-noted difficulties with field-installable connectors is not an ideal solution.

Accordingly, during movement of the connector and its internal components when mating with a port, the conductive components may break contact with other conductive components of the connector or conductors of a coaxial cable, causing undesirable passive intermodulation (PIM) results. For instance, the contact between a center conductor of a coaxial cable and a receptive clamp is critical for desirable passive intermodulation (PIM) results. Likewise, poor clamping of the coaxial cable within the connector allows the cable to displace and shift in a manner that breaks contact with the conductive components of the connector, causing undesirable PIM results. Furthermore, poor clamping causes a great deal of strain to the connector.

Thus, a need exists for an apparatus and method for a connector that provides efficient clamping of the coaxial cable and the outer conductor.

SUMMARY

A first general aspect relates to a clamp comprising an annular member having a first end and a second end, the annular member including an internally threaded portion, the internally threaded portion of the annular member configured to threadably engage a coaxial cable; and a ramped surface proximate the first end of the annular member, wherein the ramped surface is configured to engage an outer conductor of the coaxial cable, wherein the annular member is disposed within a connector body of a coaxial cable connector.

A second general aspect relates to a connector comprising a first moveable compression surface disposed within a connector body, wherein the first compression surface is a ramped surface of a clamp, the clamp including an internally threaded portion configured to threadably engage a cable jacket of the coaxial cable, and a second moveable compression surface disposed within a connector body, the second moveable compression surface configured to cooperate with the first moveable compression surface, wherein the first moveable compression surface and the second moveable compression surface pinch a flared out outer conductor of a coaxial cable upon axial compression.

A third general aspect relates to a connector comprising a connector body having a first end and a second end, the connector body configured to receive a prepared coaxial cable, the prepared coaxial cable including an outer conductor and a center conductor, a clamp disposed within the connector body, the clamp including an internally threaded portion and a ramped surface, wherein the clamp threadably engages the prepared coaxial cable, a moveable ramped component disposed within the connector body, the moveable ramped component including an internally ramped surface, and a compression member configured for axial movable engagement with the connector body, wherein, upon axial compression of the compression member, the outer conductor flares out and is pressed between the ramped surface of the clamp and the internally ramped surface of the moveable ramped component.

A fourth general aspect relates to a connector comprising a connector body having a first end and a second end, the connector body configured to receive a prepared coaxial cable, a compression member configured for axial movable engagement with the connector body, and a means to threadably engage a cable jacket of the coaxial cable, and a means to seize the outer conductor within the connector body, wherein the means to seize the outer conductor is operable via axial compression of the compression member.

A fifth general aspect relates to a method of maintaining passive intermodulation through a coaxial cable connector, the method comprising threadably engaging a coaxial cable with an internal clamp disposed within a connector body, the clamp including an internally threaded portion a ramped surface, flaring out an outer conductor of the coaxial cable against an internal ramped surface, the internal ramped surface configured to move within the connector body, and clamping the flared out outer conductor between the ramped surface of the internal clamp and the internally ramped surface through axial compression of a compression member.

A sixth general aspect relates to a method of clamping a coaxial cable comprising providing a connector including a first moveable compression surface disposed within a connector body, wherein the first compression surface is a ramped surface of a clamp, the clamp including an internally threaded portion configured to threadably engage a cable jacket of the coaxial cable, and a second moveable compression surface disposed within a connector body, the second moveable compression surface configured to cooperate with the first moveable compression surface, and axially compressing the connector to flare out and pinch an outer conductor of the coaxial cable.

A seventh general aspect relates to a device configured to be operably affixed to a coaxial cable comprising a compression connector, wherein the compression connector is configured to threadably engage the coaxial cable and transfer radio frequency waves of an outer conductor of the coaxial cable in a conical manner, wherein the compression connector achieves an intermodulation level below −155 dBc.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms “a”, “an” and “the” include plural referents, unless the context clearly dictates otherwise.

Figure 1A:
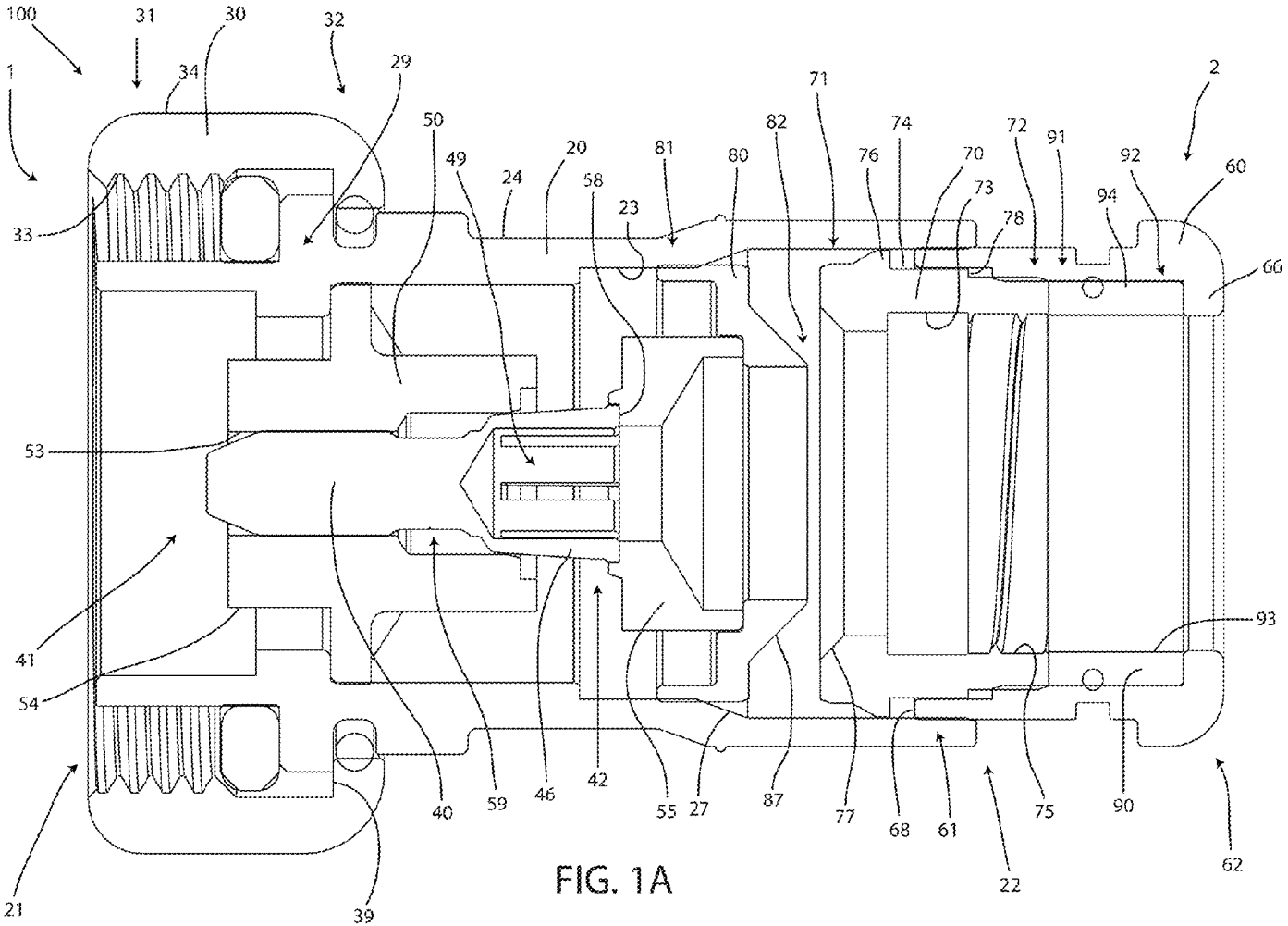
FIG. 1A depicts a cross-sectional view of a first embodiment of a connector in an open position.
Figure 1B:
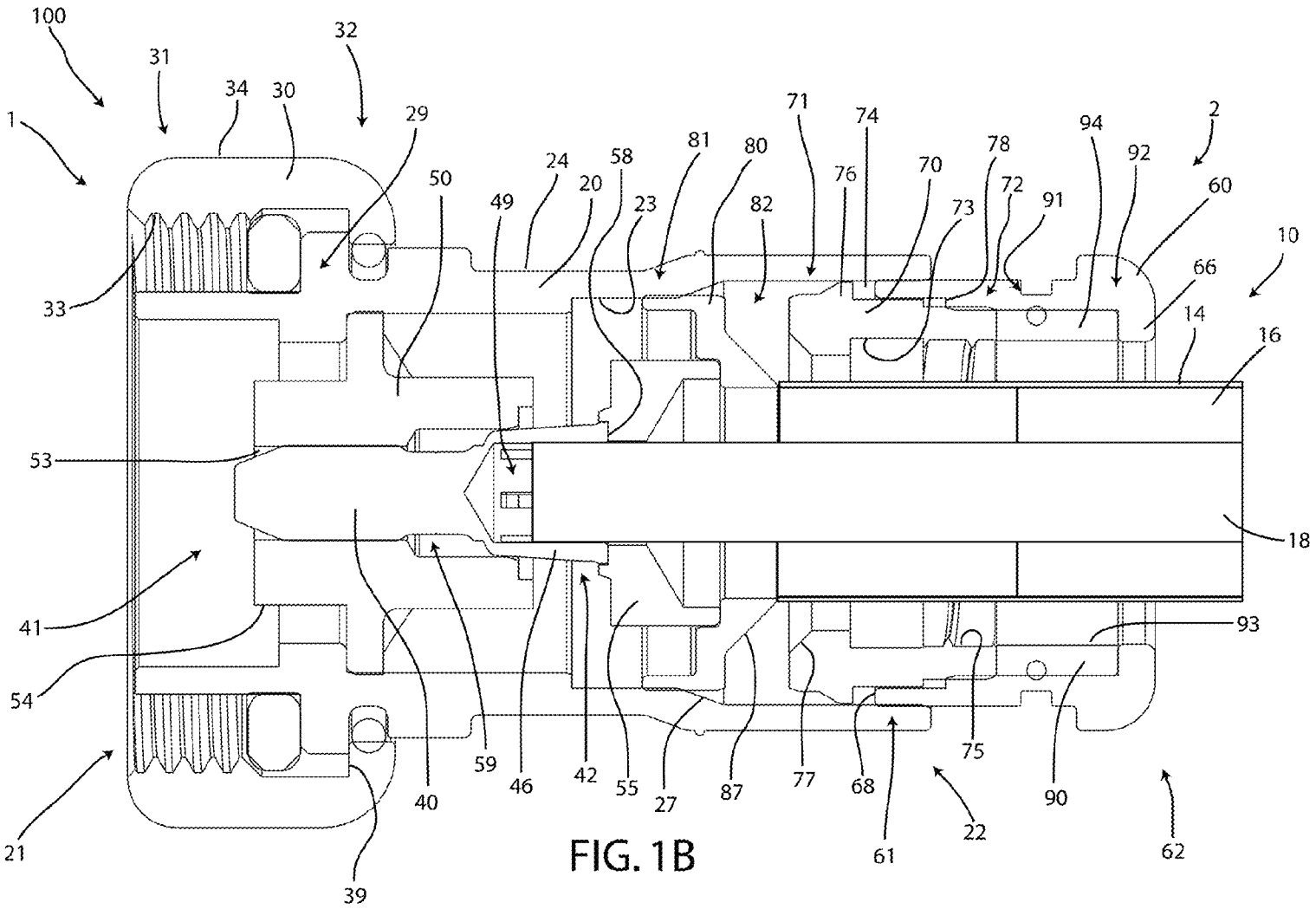
FIG. 1B depicts a cross-sectional view of a first embodiment of a connector in an open position operably attached to a coaxial cable.

Referring to the drawings, FIGS. 1A and 1B depict an embodiment of a connector 100. Connector 100 may be a straight connector, a right angle connector, an angled connector, an elbow connector, or any complimentary connector that may receive a center conductor 18 of a coaxial cable. Further embodiments of connector 100 may receive a center conductor 18 of a coaxial cable 10, wherein the coaxial cable 10 includes a corrugated, smooth wall, or otherwise exposed outer conductor 14. Connector 100 can be provided to a user in a preassembled configuration to ease handling and installation during use. Two connectors, such as connector 100 may be utilized to create a jumper that may be packaged and sold to a consumer. A jumper may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper includes both an uncompressed/open position and a compressed/closed position of the connector while affixed to the cable. For example, embodiments of a jumper may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper may include other components, such as one or more signal boosters, molded repeaters, and the like.

Figure 2B:
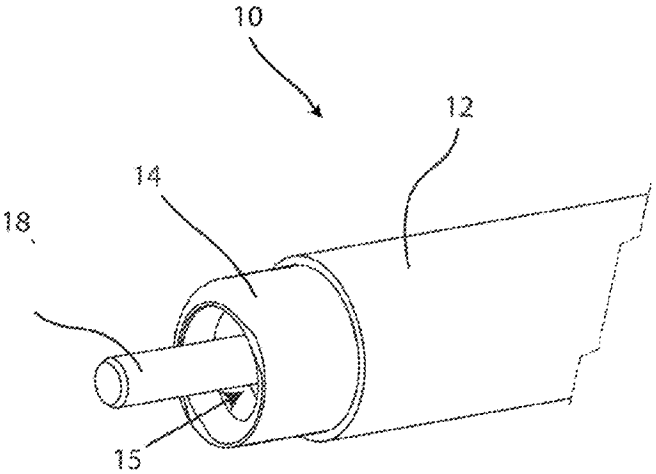
FIG. 2B depicts a perspective view of a second embodiment of the coaxial cable.
Figure 2A:
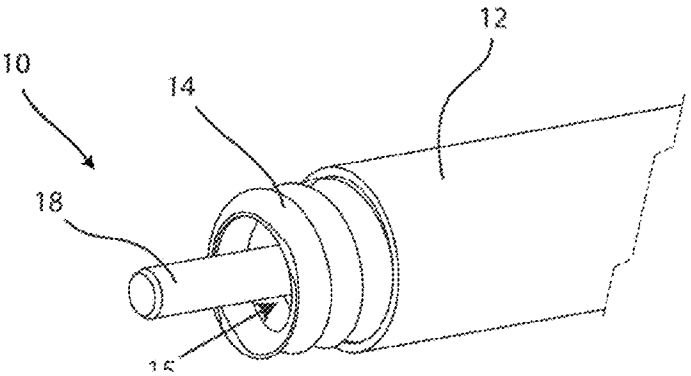
FIG. 2A depicts a perspective view of a first embodiment of a coaxial cable.
Figure 2C:
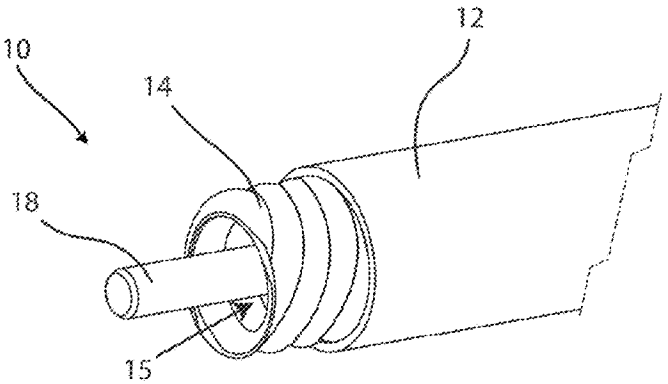
FIG. 2C depicts a perspective view of a third embodiment of the coaxial cable.

Referring to FIGS. 2A-2C, embodiments of a coaxial cable 10 may be securely attached to a coaxial cable connector. The coaxial cable 10 may include a center conductor 18, such as a strand of conductive metallic material, surrounded by an interior dielectric 16; the interior dielectric 16 may possibly be surrounded by an outer conductor 14; the outer conductor 14 is surrounded by a protective outer jacket 12, wherein the protective outer jacket 12 has dielectric properties and serves as an insulator. The outer conductor 14 may extend a grounding path providing an electromagnetic shield about the center conductor 18 of the coaxial cable 10. The outer conductor 14 may be a semi-rigid or rigid outer conductor of the coaxial cable 10 formed of conductive metallic material, and may be corrugated or otherwise grooved. For instance, the outer conductor 14 may be annularly ribbed, as shown in FIG. 2A, smooth walled, as shown in FIG. 2B, or spiral or helical corrugated, as shown in FIG. 2C. The coaxial cable 10 may be prepared by removing a portion of the protective outer jacket 12 so that a length of the outer conductor 14 may be exposed, and then coring out a portion of the dielectric 16 to create a cavity 15 or space between the outer conductor 14 and jacket 12, and the center conductor 18. The protective outer jacket 12 can physically protect the various components of the coaxial cable 10 from damage that may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. The outer conductor 14 can be comprised of conductive materials suitable for carrying electromagnetic signals and/or providing an electrical ground connection or electrical path connection. Various embodiments of the outer conductor layer 14 may be employed to screen unwanted noise. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, outer conductor 14, interior dielectric 16, and/or center conductor 18 may vary based upon generally recognized parameters corresponding to broadband communication standards and/or equipment.

Referring back to FIGS. 1A and 1B, embodiments of connector 100 may include a coupling member 30, a connector body 20, a contact 40, an insulator body 50, a moveable ramped component 80, a clamp 70, a collar 90, and a compression member 60. Further embodiments of connector 100 may include a first moveable compression surface disposed within a connector body 20, wherein the first compression surface is a ramped surface 77 of a clamp 70, the clamp 70 including an internally threaded portion 75 configured to threadably engage a cable jacket 12 of the coaxial cable 10, and a second moveable compression surface disposed within a connector body 20, the second moveable compression surface configured to cooperate with the first moveable compression surface, wherein the first moveable compression surface and the second moveable compression surface clamp a flared out outer conductor 14 of a coaxial cable 10 upon axial compression. Embodiments of connector 100 may further include a connector body 20 having a first end 21 and a second end 22, the connector body 20 configured to receive a prepared coaxial cable 10, the prepared coaxial cable 10 including an outer conductor 14 and a center conductor 18, a clamp 70 disposed within the connector body 50, the clamp 70 including an internally threaded portion 75 and a ramped surface 77, wherein the clamp 70 threadably engages the prepared coaxial cable 10, a moveable ramped component 80 disposed within the connector body 20, the moveable ramped component 80 including an internally ramped surface 77, and a compression member 60 configured for axial movable engagement with the connector body 20, wherein, upon axial compression of the compression member 60, the outer conductor 14 flares out and is pressed between the ramped surface 77 of the clamp 70 and the internally ramped surface 87 of the moveable ramped component 80.

Embodiments of connector 100 may include a connector body 20. Connector body 20 may include a first end 21, a second end 22, an inner surface 23, and an outer surface 24. Embodiments of the connector body 20 may include a generally axially opening therethrough. Embodiments of the connector body 20 may also include a retaining portion 29 proximate the first end 21 for rotatably engaging, or securably retaining, a coupling member 30. The retaining portion 29 may include an annular groove for retaining the coupling member 30. For instance, the retaining portion 29 facilitates the rotatable engagement of the coupling member 30 to the connector body 20. Proximate the second end 21 of the connector body 20, the inner diameter of the connector body 20 may be larger than the inner diameter of the connector body 20 proximate the first end 21. Moreover, the change in inner diameter of the axial opening of the connector body 20 may be defined by a ramped surface 27, which can be an annular ramped surface that tapers inward towards the first end 21 of the connector body 20. For example, the inner surface 23 of the connector body 20 may have a surface feature, such as a ramped portion, that narrows the opening within the connector body 20 which can compress the clamp 70. In other words, the clamp 70 and potentially other internal components may be radially compressed when the components are driven axially along within the connector body 20 past the ramped surface 27. In addition, the connector body 20 may be formed of metals or polymers or other materials that would facilitate a rigidly formed body. Manufacture of the connector body 20 may include casting, extruding, cutting, turning, tapping, drilling, injection molding, blow molding, or other fabrication methods that may provide efficient production of the component. Those in the art should appreciate that various embodiments of the connector body 20 may also comprise various inner or outer surface features, such as annular grooves, detents, tapers, recesses, and the like, and may include one or more structural components having insulating properties located within the connector body 20.

Referring still to FIGS. 1A and 1B, embodiments of connector 100 may include a coupling member 30. The coupling member 30 may include a first end 31, a second end 32, an inner surface 33, and an outer surface 34. Embodiments of the coupling member 30 may be a coupling member configured to mate with a corresponding port, or other connector; the coupling member 30 may include internal threads along the inner surface 33 to threadably mate with a port. The coupling member 30 may include a generally axial opening extending from the first end 31 to the second end 32. Proximate the second end 32, the coupling member 30 may include an annular lip 39 configured to cooperate with the annular groove of the connector body 20, such that the coupling member may rotate about the connector body 20 yet retained in the axial direction with respect to the connector body 20, as known to those having skill in the art. A first sealing member 36, such as an O-ring or other rubber deformable ring, may be placed within the annular groove of the connector body 20 to form an environmental seal. A second sealing member 37, such as an O-ring or other rubber deformable sealing member, may be placed within the axial opening of the coupling member 30 and against the internal lip 39 of the coupling member 30 to form yet another environmental seal. Those having skill in the art should appreciate that additional sealing members may be placed at various locations proximate the coupling member 30 to prevent moisture migration or other ingress of environmental elements. In addition, the coupling member 30 may be formed of metals or polymers or other materials that would facilitate a rigidly formed body. Manufacture of the coupling member 30 may include casting, extruding, cutting, turning, tapping, drilling, injection molding, blow molding, or other fabrication methods that may provide efficient production of the component. Those in the art should appreciate that various embodiments of the coupling member 30 may also comprise various inner or outer surface features, such as annular grooves, detents, tapers, recesses, and the like, and may include one or more structural components having insulating properties located within the coupling member 30.

With continued reference to FIGS. 1A and 1B, embodiments of connector 100 may include an electrical contact 40. Contact 40 may include a first end 41 and a second end 42. Contact 40 may be a conductive element that may extend or carry an electrical current and/or signal from a first point to a second point. Contact 40 may be a terminal, a pin, a conductor, an electrical contact, a curved contact, a bended contact, an angled contact, and the like. Embodiments of the contact 40 should be formed of conductive materials.

Moreover, embodiments of contact 40 may include a socket 46 proximate or otherwise near the first end 41. The socket 46 may be a conductive center conductor clamp or basket that clamps, grips, collects, receives, or mechanically compresses onto the center conductor 18. The socket 46 may further include an opening 49, wherein the opening 49 may be a bore, hole, channel, and the like, that may be tapered. The socket 46, in particular, the opening 49 of the socket 46 may accept, receive, and/or clamp an incoming center conductor 18 of the coaxial cable 10 as a coaxial cable 10 is further inserted into the connector body 20 to achieve a closed position. The socket 46 may include a plurality of engagement fingers 47 that may permit deflection and reduce (or increase) the diameter or general size of the opening 49. In other words, the socket 46 of contact 40 may be slotted or otherwise resilient to permit deflection of the socket 46 as the coaxial cable 10 is further inserted into the connector body 20 to achieve a closed position, or as the compression member 60 is axially displaced further onto connector body 20.

Referring still to FIGS. 1A and 1B, embodiments of connector 100 may include an insulator body 50. Embodiments of connector 100 may also include an insulator body 50. The insulator body 50 may include a first end 51, a second end 52, an inner surface 53, and an outer surface 54. The insulator body 50 may be disposed within the connector body 20, wherein the insulator body 50 surrounds or substantially surrounds at least a portion of contact 40. Moreover, the insulator body 50 may include an axially extending opening 59 which may extend from the first end 51 through the second end 52. The opening 59 may be a bore, hole, channel, tunnel, and the like. The insulator body 50, in particular, the opening 59 of the insulator body 50, may accept, receive, accommodate, etc., the axially displaced electrical contact 40 as a coaxial cable 10 is further inserted into the connector body 20. Embodiments of the insulator body 50 should be made of non-conductive, insulator materials. Manufacture of the insulator body 50 may include casting, extruding, cutting, turning, drilling, compression molding, injection molding, spraying, or other fabrication methods that may provide efficient production of the component.

Embodiments of connector 100 may further include a moveable ramped component 80. The moveable ramped component 80 may have first end 81 and a second end 82, and may have a general axial opening therethrough. For instance, the moveable ramped component 80 may be a generally annular member having a ramped, compression surface 87 proximate the second 82, wherein the moveable ramped component 80 is configured to be axially displaced within the connector body 20 in a direction towards the first end 1 of the connector 100. However, embodiments of the ramped component 80 may not be configured to be moved within the connector upon axial compression, but rather press-fit to a final location during assembly. Embodiments of the moveable ramped component 80 may have an inner ramped surface 87 proximate or otherwise near the second end 82. The inner ramped surface 87 may be an annular tapered portion of the moveable ramped component 80. The inner ramped surface 87 may also be referred to as a first surface, or first compression surface, wherein the first surface is configured to receive the outer conductor 14 of the coaxial cable 10 to flare it out and clamp the outer conductor 14 against a second compression surface, such as the ramped surface 77 of the clamp 70. Moreover, the moveable ramped component 80 may have a reduced opening proximate the second end 82 compared to the opening proximate the first end 81. The reduced opening proximate the second end 82 may have a diameter such that the edge of the inner ramped surface 87 proximate the second end 82 engages the outer conductor 14 at a point where the outer conductor 14 rides up the inner ramped surface 87 and flares out when the cable 10 is axially advanced into the connector body 20. Proximate the first end 81, the moveable ramped component 80 may include a diameter large enough to accommodate an insert 55 which electrically isolates the moveable ramped component 80 and the center conductor 18 and socket 46. In addition, the moveable ramped component 80 may be made of conductive materials, such as metals including copper, brass, nickel, aluminum, steel, and the like, and can be plated. Further, the moveable ramped component 80 may also be plastic with a conductive metal coating.

With continued reference to FIGS. 1A and 1B, embodiments of connector 100 may include an insert 55. Embodiments of insert 55 may be disposed within or partially within the moveable ramped component 80 to provide a driving surface against the socket 46 of electrical contact 40. For instance, the insert 55 may be interference fit within or partially within the moveable ramped component 80 to electrically isolate the moveable ramped component 80 and the socket 46 (and center conductor 18), as well as provide an engagement surface 58 to physically contact/engage the socket 46. The engagement surface 58 of the insert 55, will act as a driver of the socket 46, and ultimately the contact 40, further into the opening 59 of the insulator body 50 when the connector is axially compressed and moved to a closed position. Embodiments of insert 55 should be made of non-conductive, insulator materials. Manufacture of the insert 55 may include casting, extruding, cutting, turning, drilling, compression molding, injection molding, spraying, or other fabrication methods that may provide efficient production of the component.

Furthermore, embodiments of connector 100 may include a clamp 70. Embodiments of the clamp 70 may be a clamp, a seizing element, an outer conductor-cable engagement member, a clamp driver, a seal driver, or any generally annular member configured to compress and/or clamp a coaxial cable 10 and an outer conductor 14. Embodiments of the clamp 70 may be a solid, generally annular, internally threaded member. For example, embodiments of the clamp 70 may be an annular member having a first end 71 and a second end 72, an inner surface 73, an outer surface 74, and a generally axial opening therethrough. Embodiments of a solid clamp 70 may include a clamp having one or more slots to provide some resiliency, and may also include a clamp having a continuous, uninterrupted revolution across the axial distance of the clamp. Further embodiments of the clamp 70 may be slotted proximate or otherwise near the second end 72, such that the threaded end of the clamp 70 engaging the cable 10 may be slotted or flexible, while the rest of the clamp 70 does not include slots. The clamp 70 may be disposed within the connector body 20; however, a portion of the clamp 70 may extend beyond the connector body 20 proximate the second end 2 of the connector in the open position. Embodiments of connector 100 may include clearance between the inner surface 23 of the connector body 20 and the outer surface 74 of the clamp 70 to allow axial insertion of the compression member 60; however, clamp 70 may include a protrusion 76 that can extend to the inner surface 23 of the connector 20 to establish a press-fit relationship with the connector body 20. Furthermore, embodiments of the clamp 70 may include an annular edge 78 configured to engage an internal lip 68 of the compression member 60 facilitate axial displacement of the clamp 70 (and the cable 10 threadably engaged therewith).

Proximate the second end 72, the inner surface 73 of the clamp 70 may include a threaded portion 75 for threaded engagement with the cable jacket 12. As described in greater detail infra, once the connector 100 is initially inserted onto a prepared end of the cable 10, the connector 100 can be threaded onto the cable 10 to facilitate threaded engagement between the cable 10 and the connector 100. Moreover, proximate the first end 71, the clamp 70 may include a ramped surface 77. The ramped surface 77 of the clamp 70 may oppose the ramped surface 87 of the moveable ramped component 80. In other words, the ramped surface 77 of the clamp 70 may correspond to and cooperate with the inner ramped surface 87 of the moveable ramped component 80 such that the outer conductor 14 may be clamped, seized, sandwiched, etc. between the ramped surfaces 77, 87. Embodiments of the ramped surface 77 of the clamp 70 may be referred to as a second surface, or second compression surface, wherein the second surface is configured to axially compress against the outer conductor 14 which has been flared out by the first surface, or inner ramped surface 87 of the moveable ramped component 80.

Accordingly, the clamp 70 may threadably engage the cable 10 when the connector 100 is threaded onto the prepared end of the cable 10, and may also compressively engage the cable 10 during compression of the compression member 60 due to the reduced opening defined by the ramped surface 27 tapers inward towards the first end 21 of the connector body 20. Threadably engaging the cable 10 with the clamp 70, which is an internal component, disposed within the connector body 20, supports and retains the cable 10 when operably attached to connector 100, which can provide stability to the moving components of the connector 100 and avoid undesirable PIM results (i.e. prevent nonlinear and insecure contact between surfaces of various components of the connector). Furthermore, the clamp 70 may be made of non-conductive materials. For example, the clamp 70 may be made of plastics, composites, hard plastics, or other insulating material that may form a rigid, yet potentially compliant body. Manufacture of the clamp 70 may include casting, extruding, cutting, turning, drilling, compression molding, injection molding, spraying, or other fabrication methods that may provide efficient production of the component.

With reference still to FIGS. 1A and 1B, embodiments of connector 100 may include a collar 90. The collar 90 may include a first end 91, a second end 92, an inner surface 93, and an outer surface 94. The collar 90 may be a generally annular tubular member. The collar 90 may be a solid sleeve collar and may be disposed within the connector body 20 proximate or otherwise near the clamp 70. For instance, collar 90 may be disposed around the cable jacket 12 of the coaxial cable 10 when the cable 10 enters the connector 100, which may form a seal around the cable 10. For instance, as the compression member 60 is axially compressed, the collar 90 may deform and sealingly engage the cable jacket 12 to prevent the ingress of environmental elements, such as rainwater. Further embodiments of the collar 90 may also include a mating edge 98 proximate or otherwise near the first end 91 that may engage the clamp 70 as the coaxial cable 10 is further inserted into the axial opening of the connector body 20. Additionally, the collar 90 should be made of non-conductive, insulator materials, and can be made of elastomeric materials. Manufacture of the collar 90 may include casting, extruding, cutting, turning, drilling, compression molding, injection molding, spraying, or other fabrication methods that may provide efficient production of the component.

Figure 3A:
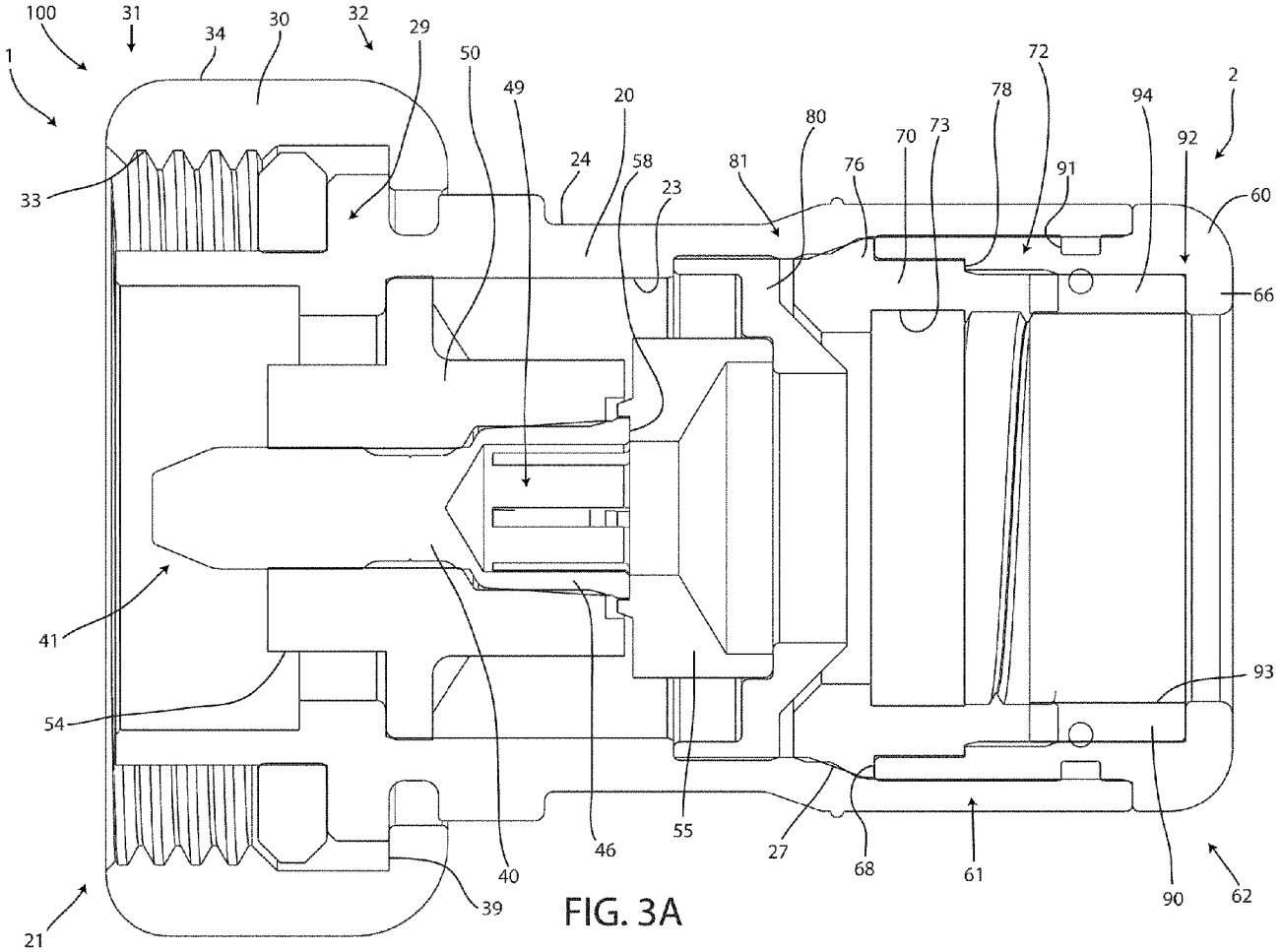
FIG. 3A depicts a cross-sectional view of an embodiment of the connector in a closed position.
Figure 3B:
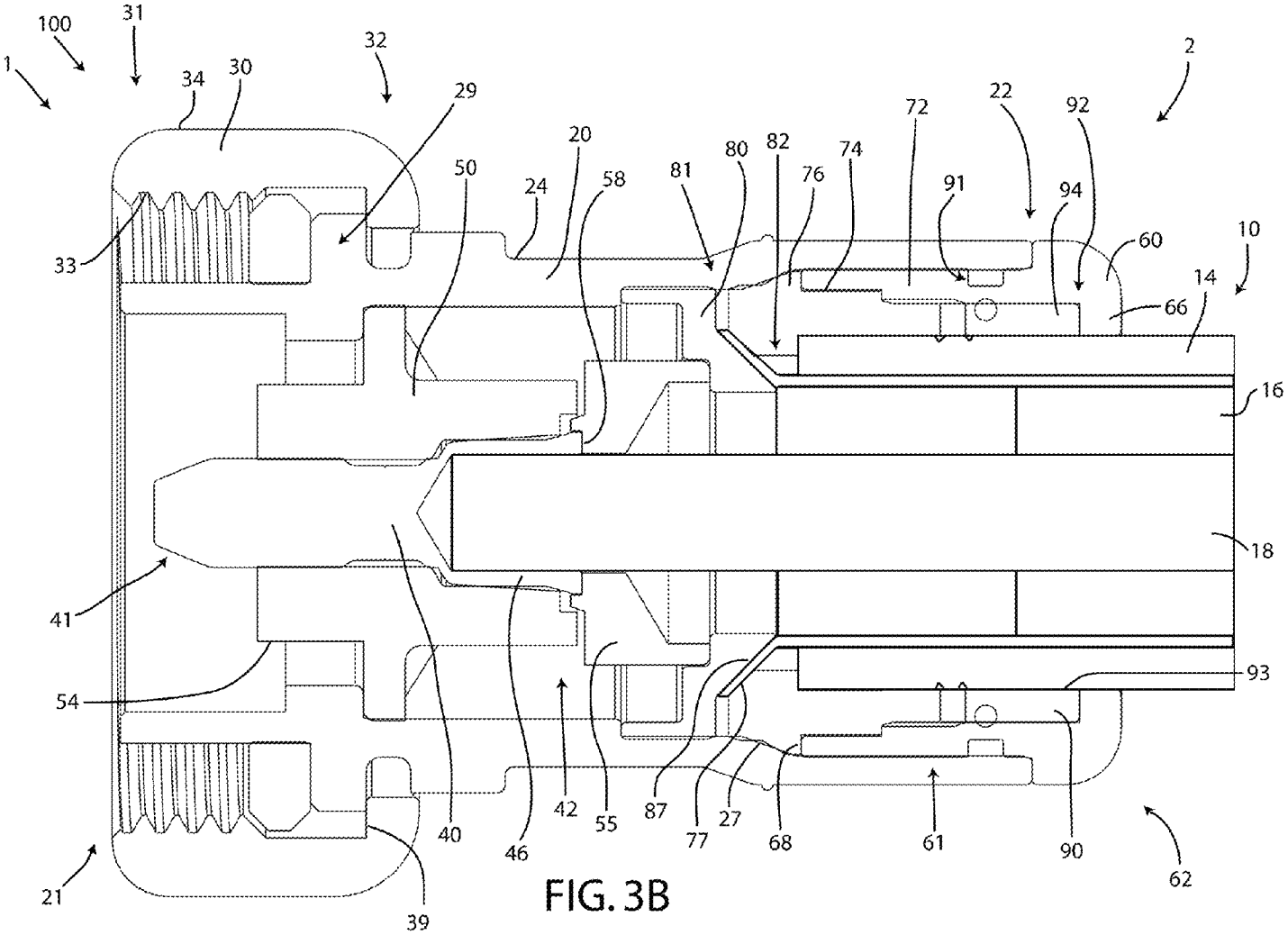
FIG. 3B depicts a cross-sectional view of an embodiment of the connector in the closed position operably attached to the coaxial cable.

Embodiments of connector 100 may also include a compression member 60. The compression member 60 may have a first end 61, a second end 62, an inner surface 63, and an outer surface 64. The compression member 60 may be a generally annular member having a generally axial opening therethrough. The compression member 60 may be configured to be insertable within the second end 22 of the connector body 20. For instance, the compression member 60 may be axially compressed (e.g. via an axial compression tool) into the connector body 20. Proximate or otherwise near the first end 61, the compression member 60 may include an internal mating edge 68 configured to engage/contact the annular edge 78 of the clamp 70 during axial compression, or as the connector 100 moves from an open position, as shown in FIGS. 1A and 1B, to a closed position, as shown in FIGS. 3A and 3B. For instance, the compression member 60 may axially slide towards the first end 21 of the connector body 20 to contact the internal mating edge 68 to help drive the clamp 70 threadably engaged with the cable 10 towards the first end 1 of the connector 100. Moreover, the compression member 60 may include an annular lip 66 proximate or otherwise near the second end 62. The annular lip 66 may be configured to engage the collar 90, and help compressibly deform the collar 90 to effectuate a seal proximate the second end 2 of the connector 100, as well as help drive the clamp 70 threadably engaged with the cable 10 towards the first end 1 of the connector 100. The compression member 60 may further include an annular groove 67 that may house, retain, etc., a sealing member 69, such as an elastomeric O-ring or other deformable sealing member. Furthermore, it should be recognized, by those skilled in the requisite art, that the compression member 60 may be formed of rigid materials such as metals, hard plastics, polymers, composites and the like, and/or combinations thereof. Furthermore, the compression member 60 may be manufactured via casting, extruding, cutting, turning, drilling, knurling, injection molding, combinations thereof, or other fabrication methods that may provide efficient production of the component.

Referring now to FIGS. 1A and 1B and FIGS. 3A and 3B, the manner in which connector 100 may move from an open position to a closed position to clamp and seize the coaxial cable 10 and the outer conductor 14 is now described. FIGS. 1A and 1B depicts an embodiment of the connector 100 in an open position. The open position may refer to a position or arrangement wherein the center conductor 18 of the coaxial cable 10 is not clamped or captured by the socket 46 of contact 40, or only partially/initially clamped or captured by the socket 46. The open position may also refer to a position prior to axial compression of the compression member 60. The cable 10 may enter the generally axially opening of the compression member 60 and connector body 20 as the pre-assembled connector 100 is drawn over the cable 10. Once the clamp 70 is positioned over the cable jacket 12 proximate the prepared end of the cable 10, the connector 100 may be rotated or otherwise threaded to threadably engage the cable 10. For example, the threaded portion 75 of the clamp 70 may threadably engage the cable jacket 12 when the connector 100 is rotated or twisted about the cable 10. Alternatively, in other embodiments, the coaxial cable 10 may be rotated or twisted to provide the necessary rotational movement to mechanically threadably engage the clamp 70. The threadable engagement between the cable 10 and the clamp 70 may establish a mechanical connection between the connector 100 and the coaxial cable 10. In addition, threadably engaging the cable 10 with the internal clamp 10 can prevent unwanted movement and shifting of the cable 10, thereby resulting in desirable PIM results.

FIGS. 3A and 3B depict an embodiment of a closed position of the connector 100. The closed position may refer to a position or arrangement of the connector 100 wherein the center conductor 18 is fully clamped or accepted by the socket 46 of contact 40 and the contact 40 is driven within the opening 59 of the insulator body 50, the outer conductor 14 of the coaxial cable 10 is clamped/seized between the clamp 70 and the moveable ramped component 80, or a combination thereof. The closed position may be achieved by axially compressing the compression member 60 into the connector body 20. For instance, the compression member 60 may extend an axial distance so that, when the compression member 60 is compressed into a sealing position on the coaxial cable 100, a mating edge 66 of the compression member 60 may touch or reside proximate or otherwise near a mating edge 26 of the connector body 20. The axial movement of the compression member 60 can axially displace the cable 10 and other components disposed within the connector body 20 because the compression member 60 can mechanically engage the connector 100 components at one or more locations. For instance, the internal mating edge 68 of the compression member 60 is configured to mechanically engage the mating edge 78 of the clamp 70 and the annular lip 66 of the compression member 60 is configured to mechanically engage the collar 90 which depresses against the clamp 70. One or more of the mechanical engagement between the compression member 60 and the connector 100 components may cause the axial displacement of the components when the compression member 60 is axially compressed.

As the compression member 60 is axially compressed and the connector 100 moves to a closed position, the outer conductor 14 can be clamped, sandwiched, retained, seized, etc., between the clamp 70 and the moveable ramped component 80. For instance, upon axial compression, the moveable ramped component 80 can be driven axially towards the first end 1 of the connector 100 such that the moveable ramped component 80 moves within the connector body 20, thus creating a moveable ramped surface, or moveable compression surface. Because the insert 55 may share an interference fit with the moveable ramped component 80, the insert 55 also moves within the connector body 20; the engagement surface 58 of the insert 55 may physically engage the socket 46 of the contact 40 to drive the contact within the opening 59 of the insulator body 50, and ultimately clamp and seize the center conductor 18. Moreover, as the moveable ramped component 80 moves within the connector body 20, the outer conductor 14 may begin to ride up along the ramped surface 87 and flare out. The outer conductor 14 may continue to ride up the internal ramped surface 87 during compression. In the meantime, the clamp 70 is also moving with the cable 10 during axial compression. The ramped surface 77 of the clamp 70 may act to clasp, clamp, engage, nip, press, pinch or otherwise retain the flared out outer conductor 14 against the internal ramped surface 87 of the moveable ramped portion 80. In the closed position, after axial compression, the outer conductor 14 may be flared out and pressed between the clamp 70 and the moveable ramped component 80, thus seizing the outer conductor and further preventing unwanted movement and shifting of the cable 10, thereby obtaining desirable PIM results. Furthermore, desirable results occur because the flaring out of the outer conductor 14 allows a smooth transition of radio frequency (RF) waves transitioning from the outer conductor 14 to other conductive components of the connector 100, such as the connector body 20, to extend an electromagnetic shield through the connector 100. For example, instead of an immediate RF transition from the outer conductor 14 to the connector body 20, the RF can smoothly transition in a conical manner because of the conical end of the clamp 70 and the conical end of the ramped component 80.

Axial compression of the compression member 60, as shown in the closed position, may irreversibly engage the cable 10, including the center conductor 18 and the outer conductor 14. For instance, axial compression of the compression member 60 may irreversibly engage/seize the outer conductor 14 between the internal ramped surface 87 of the moveable ramped component 80 and the ramped surface 77 of the clamp 70. In addition, the axial compression may also irreversibly seize the center conductor 18 because the socket 46 of the electrical contact 40 has been axially compressed into the opening 59 of the insulator body 50. Irreversible engagement of the cable 10 can mean that movement of the compression member 60 in the opposite direction (i.e. towards the second end 2 of the connector) after axial compression would not loosen the mechanical engagement between the seizing and/or clamping connector 100 components and the center conductor 18 and the outer conductor 14. For example, once the compression member 60 is compressed, the center conductor 18 will remain securely engaged within the socket 46 that is securely retained within the opening 59 of the insulator body 50, which is securely retained within the connector body 20, even if the compression member 60 is removed or otherwise disengaged. Likewise, once the compression member 60 is compressed, the outer conductor 14 will remain securely engaged/pinched between the internal ramped surface 87 of the moveable ramped component 80, which is securely retained within the connector body 20 at a location closer to the first end 1 of the connector than prior to axial compression, and the ramped surface 77 of the clamp 70, which is securely retained within the connector at a location closer to the first end 1 of the connector 100 than prior to compression, while also still threadably engaged with the cable jacket 12, even if the compression member 60 is removed or otherwise disengaged. Accordingly, axially compressing a compression member can securely retain electrical-mechanical components within a connector, such as connector 100, in a permanent fashion, so as to ensure proper and secure contact between conductive components, regardless if the connector 100 is jostled, mishandled, and/or partially disassembled, such as removal of the compression member 60, or otherwise subjected to use common to coaxial cable connectors. Permanent fashion and irreversible engagement does not imply that it is absolutely impossible for the connector components to relinquish mechanical engagement of the cable 10, including the center conductor 18 and the outer conductor 14, if subjected to extreme forces, but can mean that the connector components will not relinquish mechanical engagement with the cable 10 if subjected to more than ordinary forces commonly experienced by connectors installed or otherwise used in the field of wireless and cellular communication equipment. Thus, this superior engagement of the cable 10 is done simply by attaching a preassembled connector, such as connector 100, onto a prepared end of a coaxial cable 10, and axially compressing a compression member 60 using a compression tool known to those having skill in the art.

Figure 4:
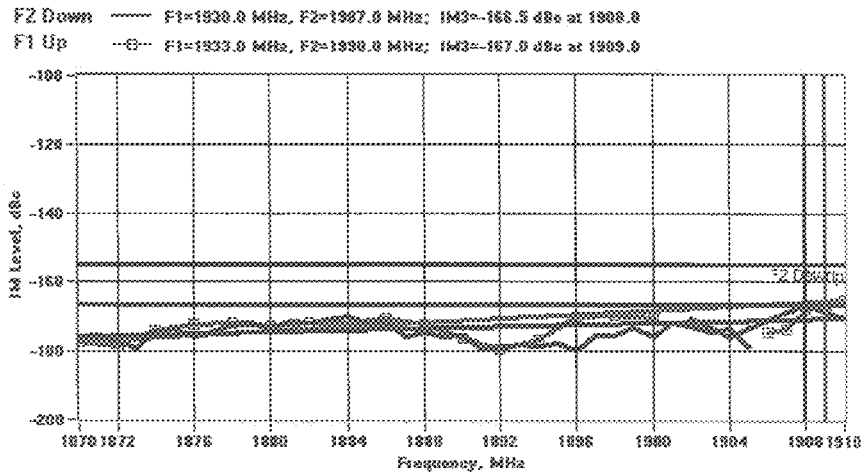
FIG. 4 depicts a graph displaying data and test results regarding performance of the connector.

FIG. 4 discloses a chart showing the results of PIM testing performed on the coaxial cable 10 that was terminated using the example compression connector 100. The particular test used is known to those having skill in the requisite art as the International Electrotechnical Commission (IEC) Rotational Test. The PIM testing that produced the results in the chart was also performed under dynamic conditions with impulses and vibrations applied to the example compression connector 100 during the testing. As disclosed in the chart, the PIM levels of the example compression connector, 100 were measured on signals F1 UP and F2 DOWN to vary significantly less across frequencies 1870-1910 MHz. Further, the PIM levels of the example compression connector 100 remained well below the minimum acceptable industry standard of −155 dBc. For example, F1 UP achieved an intermodulation (IM) level of −167.0 dBc at 1909 MHz, while F2 DOWN achieved an intermodulation (IM) level of −166.5 dBc at 1908 MHz. These superior PIM levels of the example compression connector 100 are due at least in part to the threadable engagement of the coaxial cable 10 and clamping of the flared out outer conductor 14 when the connector 100 in the closed position, as described supra.

Compression connectors having PIM levels above this minimum acceptable standard of −155 dBc result in interfering RF signals that disrupt communication between sensitive receiver and transmitter equipment on the tower and lower-powered cellular devices in 4G systems. Advantageously, the relatively low PIM levels achieved using the example compression connector 100 surpass the minimum acceptable level of −155 dBc, thus reducing these interfering RF signals. Accordingly, the example field-installable compression connector 100 enables coaxial cable technicians to perform terminations of coaxial cable in the field that have sufficiently low levels of PIM to enable reliable 4G wireless communication. Advantageously, the example field-installable compression connector 100 exhibits impedance matching and PIM characteristics that match or exceed the corresponding characteristics of less convenient factory-installed soldered or welded connectors on pre-fabricated jumper cables. Accordingly, embodiments of connector 100 may be a compression connector, wherein the compression connector achieves an intermodulation level below −155 dBc over a frequency of 1870 MHz to 1910 MHz.

Referring now to FIGS. 1-4, a method of clamping a coaxial cable 10 and an outer conductor 14 may include the steps of threadably engaging a coaxial cable 10 with an internal clamp 70 disposed within a connector body, the clamp including an internally threaded portion 75 a ramped surface 77, flaring out an outer conductor 14 of the coaxial cable 10 against an internal ramped surface 87, the internal ramped surface 87 configured to move within the connector body 20, and clamping the flared out outer conductor 14 between the ramped surface 77 of the internal clamp 70 and the internally ramped surface 87 through axial compression of a compression member 60. Furthermore, a method of clamping a coaxial cable 10 may comprise the steps of providing a connector 100 including a first moveable compression surface, such as ramped surface 77, disposed within a connector body 20, wherein the first compression surface is a ramped surface of a clamp 70, the clamp 70 including an internally threaded portion 75 configured to threadably engage a cable jacket 12 of the coaxial cable 10, and a second moveable compression surface, such as internally ramped surface 87, disposed within a connector body 20, the second moveable compression surface configured to cooperate with the first moveable compression surface, and axially compressing the connector 100 to flare out and clamp an outer conductor 14 of the coaxial cable 10.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A connector comprising:

a first moveable compression surface disposed within a connector body, wherein the first compression surface is a ramped surface of a clamp, the clamp including an internally threaded portion configured to threadably engage a cable jacket of a coaxial cable; and a second moveable compression surface disposed within a connector body, the second moveable compression surface configured to cooperate with the first moveable compression surface;

wherein the first moveable compression surface and the second moveable compression surface clamp a flared out portion of the outer conductor of the coaxial cable upon slidable axial compression, and wherein the slidable axial compression irreversibly engages the outer and center conductors of the coaxial cable.

2. The connector of claim 1, wherein the slidable axial compression is delivered by slidable axial compression of a compression member insertable within or over the connector body.

3. A connector comprising:

a connector body having a first end and a second end, the connector body configured to receive a prepared coaxial cable, the prepared coaxial cable including an outer conductor and a center conductor;

a clamp disposed within the connector body, the clamp including an internally threaded portion and a ramped surface, wherein the clamp threadably engages the prepared coaxial cable;

a moveable ramped component disposed within the connector body, the moveable ramped component including an internally ramped surface; and a compression member configured for axial movable engagement with the connector body;

wherein, upon axial compression of the compression member, the outer conductor flares out and is pressed between the ramped surface of the clamp and the internally ramped surface of the moveable ramped component, and wherein the center and the outer conductors are irreversibly seized by the axial compression of the compression member.

4. The connector of claim 3, further comprising:

an electrical contact having a socket, the socket disposed within the connector body and configured to receive the center conductor of the coaxial cable; and an insulator body disposed within the connector body, the insulator body having a first end and a second end; and an insert disposed within the connector body to electrically isolate the outer conductor and the center conductor.

5. The connector of claim 3, wherein a collar is disposed proximate the clamp to form a seal around the coaxial cable.

* * * * *